United States Patent [19]

Hungerford

[11] 4,058,074

[45] Nov. 15, 1977

[54] ANCHOR CHOCK

[75] Inventor: Daniel Comstock Hungerford, North Palm Beach, Fla.

[73] Assignee: Brunswick Corporation, Skokie, Ill.

[21] Appl. No.: 441,660

[22] Filed: Feb. 11, 1974

[51] Int. Cl.[2] ..... B63B 21/22

[52] U.S. Cl. ..... 114/210; 114/221 R

[58] Field of Search ..... 114/210, 293–300, 114/221 R, 292/19; 200/15, 162; 248/113

[56] References Cited

U.S. PATENT DOCUMENTS

| | | | |
|---|---|---|---|
| 307,761 | 11/1884 | Harger | 248/113 |
| 1,262,920 | 4/1918 | Chouvaldjy | 248/113 |
| 2,705,467 | 4/1955 | Ogg et al. | 114/206 R |
| 2,954,004 | 9/1960 | Evans, Jr. | 114/210 |
| 3,101,067 | 8/1963 | Brydon | 114/210 |
| 3,785,323 | 1/1974 | Lantz | 114/210 |

*Primary Examiner*—Trygve M. Blix
*Assistant Examiner*—Stuart M. Goldstein
*Attorney, Agent, or Firm*—Malin & Haley

[57] ABSTRACT

A twin fluke marine anchor chock for securing a marine anchor to the deck or hull of a vessel whenever the anchor is not in use. The anchor is removeably locked to the chock by the interaction of an anchor body (crown or stock) securing connector disposed at one end of the chock and a shank down-lock which secures the shank to the chock. The chock may include a shank actuated, resilient fluke locking means. An anchor may be quickly secured or released from the chock by manual rotation of the shank.

3 Claims, 9 Drawing Figures

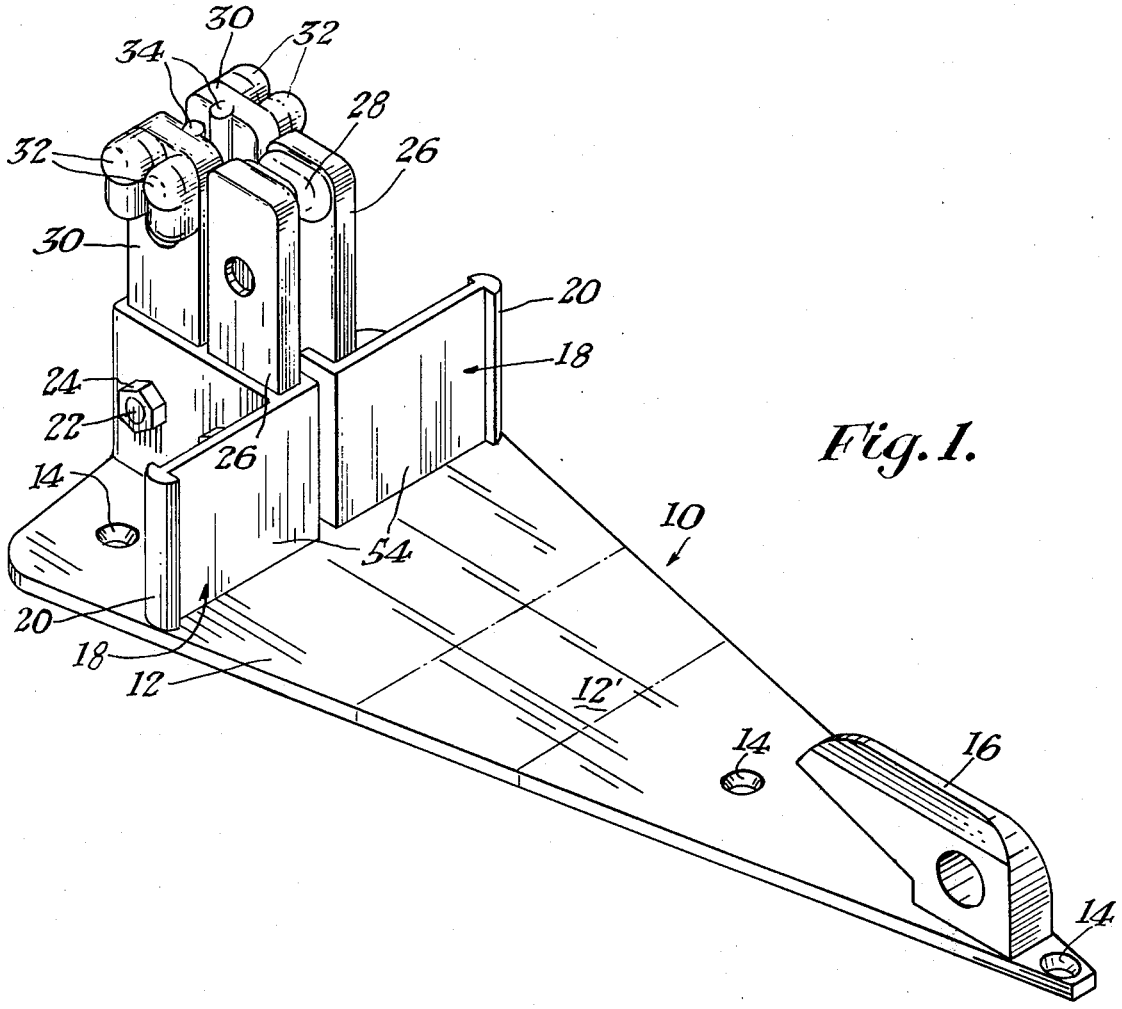
Fig. 1.
Fig. 2.
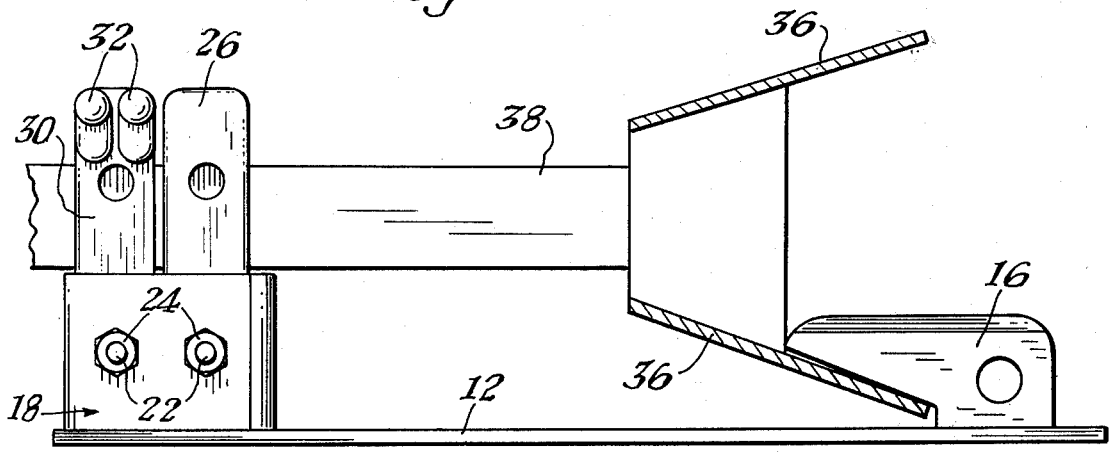

ANCHOR CHOCK

BACKGROUND OF THE INVENTION

This invention relates generally to an anchor chock and more specifically to a twin fluke anchor chock mountable on a marine vessel deck or hull which holds a twin fluke anchor firmly to the vessel deck when the anchor is not in use.

Because a marine vessel is subject to random, sudden movement due to wave action which often may be violent in any direction, it is essential that an anchor chock firmly hold the anchor to the deck when the anchor is not in use. In the past, to accomplish this has required an elaborate mechanism or tie-down system which makes it difficult to quickly secure or remove an anchor from the chock. However, it is often necessary that the anchor be quickly removed from the chock to insure safe maneuvering of the vessel. The prior art does not disclose an anchor chock which firmly and securely holds an anchor when not in use while allowing for quickly securing or releasing the anchor when necessary. Ogg, et al, U.S. Pat. No. 2,705,467, discloses an anchor mounting device that includes a cleat to which the shank is attached by a line which may become tangled, fouled and worn. Evans Jr., U.S. Pat. No. 2,954,004, shows an anchor chock which spring loads the anchor to the chock.

Applicant's invention overcomes the problems of the prior art by providing an anchor chock to which a twin fluke anchor may be quickly but firmly locked or released by rotation of the shank. Further, applicant's anchor chock is non-complex in assemblage, construction and design.

BRIEF DESCRIPTION OF THE INVENTION

A marine anchor chock for securing a twin fluke anchor to the deck of a vessel, said twin fluke marine anchor having a crown, a shank moveably coupled to said crown, a stock coupled to said crown, and a pair of flukes symmetrically disposed and connected on opposite sides of said crown, said chock comprising a base plate which is mountable on a vessel hull or deck, said plate having disposed at one end an anchor body holding means and at the opposite end a shank actuated, resilient shank down-locking means. The shank down-lock is comprised of a first pair of resilient fingers disposed in a housing connected to said base plate, each finger connected at its lower end to said housing and having an inwardly disposed flange at its upper end. The flanged portion of the fingers are disposed in the plane of rotation of the shank and firmly hold the shank in a down-locked position against the upper surface of the housing.

In an alternate embodiment, the anchor chock may include a shank actuated fluke locking means comprising a second pair of resilient fingers, each finger having on its inner side a spreader disposed in the plane of rotation of the shank which engages a lateral side of the anchor shank in the down-lock position causing the second pair of fingers to diverge, each finger having an outwardly disposed projection which engages and locks the inner side and top of each fluke edge firmly but resiliently to the second pair of fingers. This prevents upward and sideward motion of the flukes whenever the shank is disposed between the spreaders of the second pair of fingers.

The anchor body is received into a receptacle disposed adjacent one end of the base plate which may be adapted to engage either a crown plate, a stock, or the rear edges of the flukes to prevent rearward and upward movement of the anchor body from the chock base when in the locked position. Thus, the anchor chock resiliently locks a twin fluke anchor to the chock at the body portion of the anchor, along the shank, and to the flukes. The chock base plate is mountable in a conventional manner to the hull or deck of a vessel in any position with screws or other bolting means.

To engage or release an anchor from the chock, the shank is manually rotated to a position between or without the resilient fingers while the anchor body, such as the crown plate, is inserted or removed from beneath the body base plate receptacle. Thus the anchor, when locked firmly to the chock, may be released by manually rotating the shank out of engagement with the resilient fingers until the shank is free. The shank, acting as a lever, provides a mechanical advantage which allows for increased stiffness of the resilient fingers to insure a firm down-lock while requiring minimal manual effort for engagement or release.

It is an object of this invention to provide an improved twin fluke anchor chock.

It is another object of this invention to provide an improved twin fluke anchor chock which locks the anchor to the chock at the anchor body, shank and flukes with a single movement of the shank.

And still yet another object of this invention is to provide an anchor chock having a quick anchor release which is actuated by movement of the shank.

And yet still another object of this invention is to provide an anchor chock for a twin fluke anchor in which the flukes are down-locked to the chock by the positioning of the shank.

In accordance with these and other objects which will be apparent hereinafter, the instant invention will now be described with particular reference to the accompanying drawings.

BRIEF DESCRIPTION OF THE DRAWINGS

FIG. 1 shows a perspective view of applicant's anchor chock.

FIG. 2 shows a side elevational view of applicant's invention with an anchor attached thereto.

PREFERRED EMBODIMENT OF THE INVENTION

Figure 3:
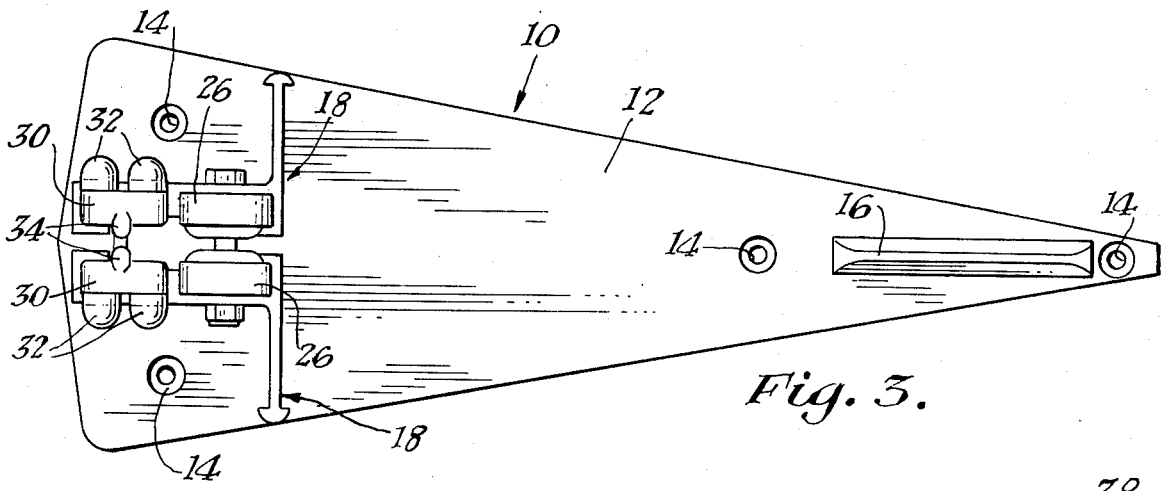
FIG. 3 shows a top plan view of applicant's invention.

Referring now to the drawings, especially FIG. 1, applicant's anchor chock is shown generally at 10 comprising a base plate 12 having a plurality of apertures 14 which receive locking members to allow the plate to be screwed or bolted to the deck or hull of a vessel. The plate 12 is triangular in shape with an anchor body receptacle attached adjacent the apex of plate 12. The receptacle receives and engages a portion of the body of a twin fluke anchor. In the preferred embodiment, the receptacle is a tongue 16 which engages the lower crown plate trailing edge of a twin fluke anchor.

Rigidly connected to the plate 12 at the end opposite tongue 16 is a housing 18 comprising vertically disposed "L" shaped plates 54 which have channel portions facing inwardly along the longitudinal, symmetrical axis of the device. Plates 54 are welded at their bottom edges to rigidly secure them to the upper surface of plate 12. Housed within and projecting vertically above the channel portions of plates 54 are a first pair of resilient symmetrically disposed fingers 26, and a second pair of resilient symmetrically disposed fingers 30. The second pair of fingers 30 have fluke locks 32 disposed on their outer surfaces and spreaders 34 disposed inwardly. The first pair of fingers 26 have upper end flanged portions 28 disposed inwardly which prevent upward vertical movement of an anchor shank when the shank is positioned between the fingers 26 and below flanges 28. Fingers 26 and 30 are rigidly connected in housing 18 by a pair of bolts 22 coupled to nuts 24. The upper horizontal end surfaces of the plates 54 engage the shank lower edge surface and the anchor flukes when the anchor is locked to the chock. The base plate 12 could be constructed in two different pieces by omitting dotted portion 12'.

FIG. 2 shows a typical twin fluke anchor having crown plates 36, the lower plate of which is engaged under tongue 16 of plate 12 firmly holding the crown in position against the inner lip of tongue 16. The anchor shank 38 is disposed and down-locked between both pairs of resilient fingers 26 and 30.

Referring now to FIG. 3, the second pair of fingers 30 include a pair of inwardly projecting spreaders 34 which are positioned to laterally engage an anchor shank when the shank is down-locked vertically by first pair of fingers 26. The spreaders 34, when engaged with the shank, diverge fingers 30 forcing the fluke locks 32 to engage the upper sides of the flukes of a twin fluke anchor.

Figure 4A:
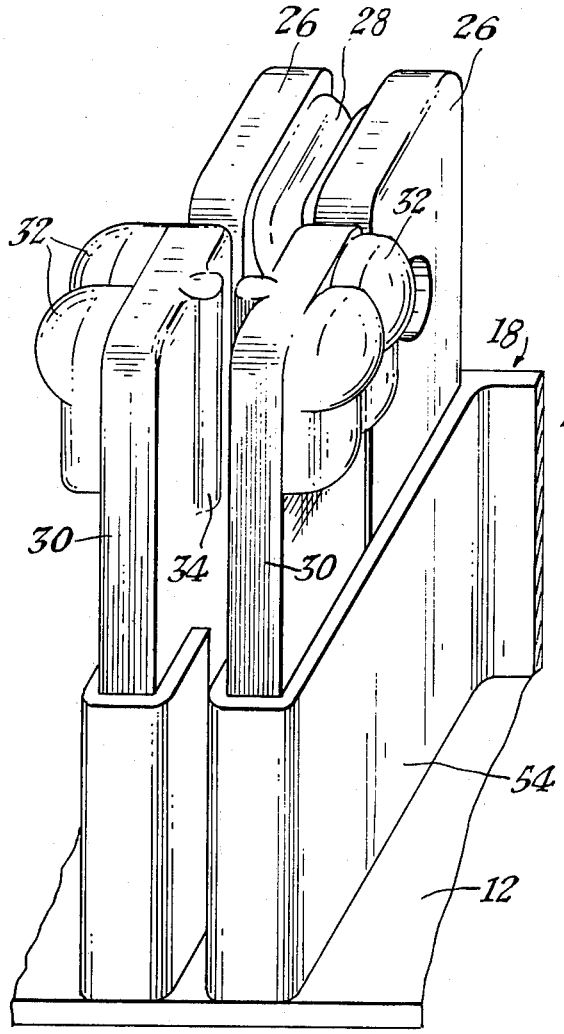
FIG. 4A shows a close-up perspective view of the shank and fluke locking members and associated coupling to the base plate.

FIG. 4A shows the shank and fluke locking mechanism without an anchor shank which includes the second pair of fingers 30 having spreaders 34 which receive a shank between them forcing the resilient fingers 30 to diverge outwardly and laterally so that the fluke down-locks 32 engage the upper and inner side edges of the flukes. When the shank is engaged between spreaders 34, the flanged portions 28 of fingers 26 prevent upward, vertical movement of the shank, locking it firmly in position. Each fluke is locked between down-lock 32 and the top surface of "L" shaped plate 54. A compression force provided by the spreaders 34 against the shank acts to hold the shank in a fixed position.

Figure 4B:
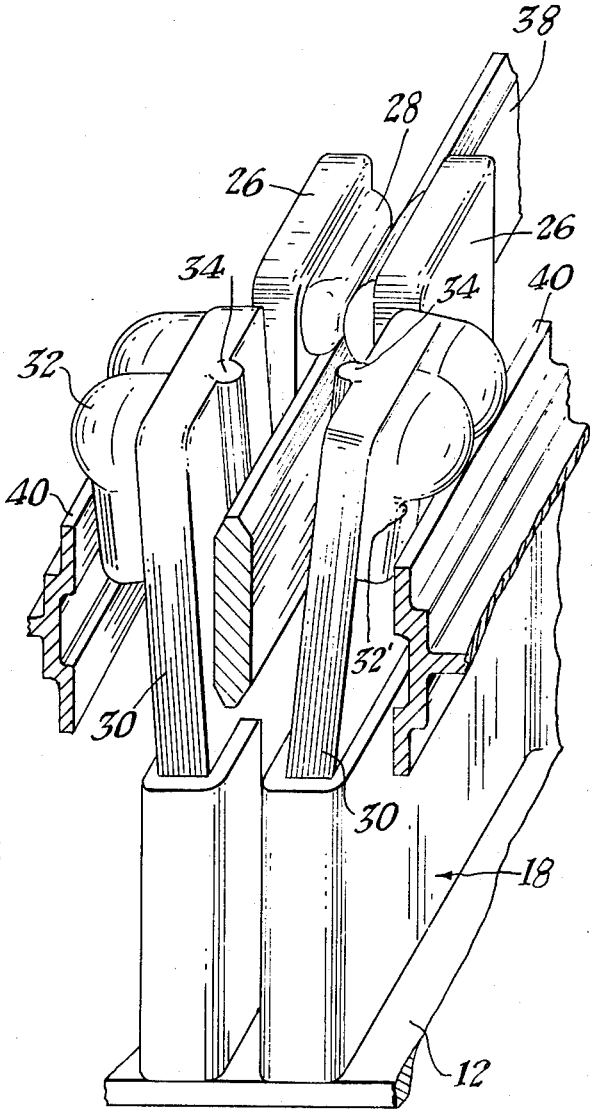
FIG. 4B shows the same view as FIG. 4A with a portion of an anchor shank engaged in the shank and fluke locking members.

FIG. 4B shows an anchor shank 38 engaged between both pairs of resilient fingers 26 and 30 causing fingers 30 to be divergently held apart by spreaders 34, the fluke lock lips 32 engaging the upper edges of flukes 40 and outer lower surface fluke locks 32 engaging the inner surface of flukes 40, firmly holding the flukes 40 from lateral or vertical motion. The flukes 40 are held on their bottom edges (not shown) by the upper surfaces of plates 54. The shank 38 is down-locked by the upper inward flanges 28 of fingers 26, spreaders 34 and the upper surface of the housing.

Figure 5:
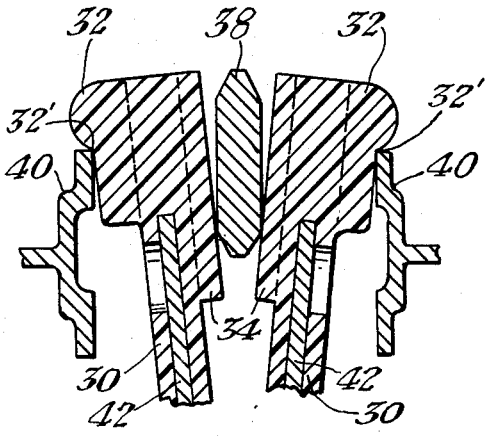
FIG. 5 shows a front elevation cross-section of the fluke locking members with fluke inner edge flanges.

FIG. 5 shows the locking action of the shank 38 and flukes 40 caused by the action of the spreaders 34 forcing the resilient fingers 30 to diverge laterally, the fluke locks 32 firmly locking the flukes 40 at their top edges along 32' preventing vertical and lateral movement of the flukes. For additional resilient compression strength, a pair of metal strips 42 may be disposed with the plastic or resilient material of fingers 30. This will increase the lateral compression force on the shank 38 in the down-lock position.

Figure 6:
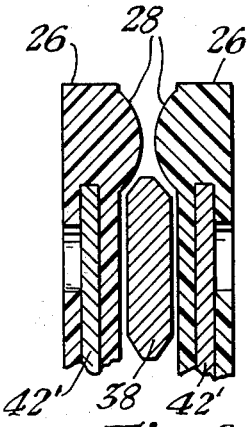
FIG. 6 shows a front elevational cross-section of the shank locking means with a shank disposed therein.

FIG. 6 shows the shank 38 in the down-locked position accomplished by the pair of fingers 26 having an inner flanged portion 28 which securely holds the shank from vertically moving upward. However, because the fingers 26 are resilient, the shank may be manually disengaged by rotation upward allowing the shank to pass through the flanged portions 28 of the fingers 26.

Figure 7:
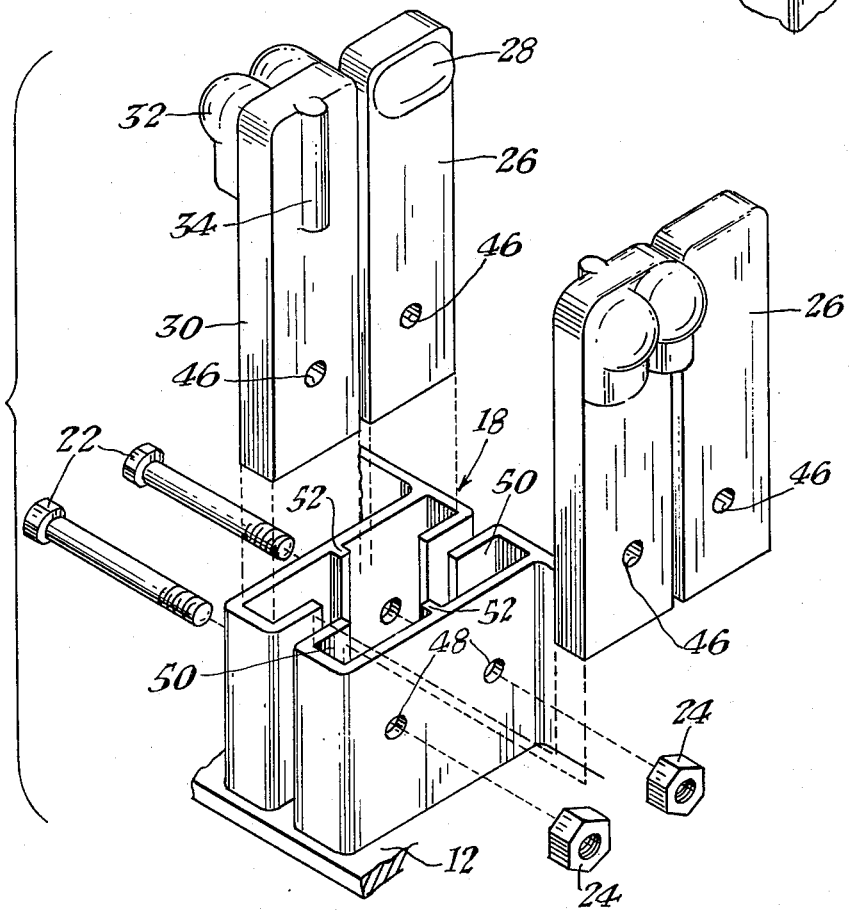
FIG. 7 shows an exploded, fragmentary, perspective view of the shank and fluke locking mechanism of applicant's invention.

FIG. 7 shows the disposition of fingers 26 and fingers 30 within housing 18. Each finger is received into a channel in housing 18 which is formed between walls 50 and 52. Each finger is received into the channel and is secured to the housing 18 by bolt 22 through finger apertures 46 and housing apertures 48. The bottom portion of each finger is securely held in the housing with the upper extended portions having free lateral movement. Fingers 26 provide the inwardly flanged upper portions 28 which hold the shank in a down-locked position while fingers 30 provide inwardly disposed spreaders 34. Of course, other modifications of the fingers are possible in that they may be independently received and connected within the housing.

Figure 8:
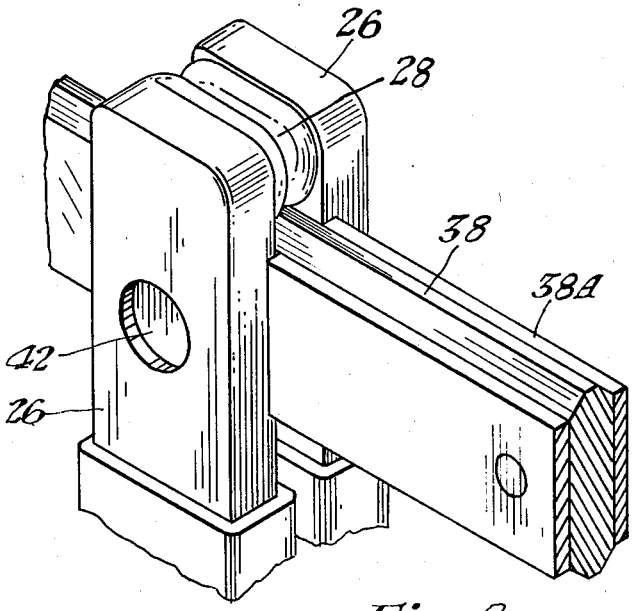
FIG. 8 shows applicant's shank lock in perspective utilized with a particular anchor shank.

FIG. 8 shows the utilization of applicant's improved anchor chock with a twin fluke anchor such as disclosed in the D. C. Hungerford patent, U.S. Pat. No. 3,771,486, in which the shank 38 has an enlarged portion 38A adjacent the crown which is further adapted to prevent longitudinal forward motion of the shank due to the positioning of the shank down-lock fingers 26 which prevent longitudinal movement of the anchor within the chock itself. Thus, applicant's anchor chock is especially adapted to securely hold down an anchor having such a shank.

In operation (FIG. 1) a twin fluke anchor (not shown) is secured to the anchor chock 10 by first positioning the lower crown plate firmly beneath tongue 16 of plate 12. The flukes are then positioned to rest upon the upper surfaces of plates 54. The shank is then rotated downwardly through the over-lock of fingers 26 and engaged with the spreaders 34 of fingers 30. In this position, the entire anchor is firmly locked to the chock at the shank, flukes and crown plate. To remove the anchor, the shank is manually rotated upward allowing it to be disengaged from the fingers 26 and 30; the crown plate is then removed from tongue 16.

Although the preferred embodiment has shown the anchor body locked at the lower crown plate, modifications may be made so that the anchor body is locked to any portion of the crown housing, the anchor stock or even the rear portions of the anchor flukes themselves to firmly hold the anchor body down at one end of the chock. Also if it is not desirous to provide a fluke lock, the device will operate with only a single pair of fingers which provide a resilient down-locking of the shank.

The instant invention has been shown and described herein in what is considered to be the most practical and preferred embodiment. It is recognized however, that departures may be made therefrom within the scope of the invention and that obvious modificatons will occur to a person skilled in the art.

What I claim is:

1. A device for securing a twin fluke anchor having an anchor body including a crown, a stock, a pivotable shank, and a pair of flukes substantially in a common plane, the device comprising:

base supporting means;

means connected to said base supporting means for engaging said anchor body;

resilient shank-actuated clamp connector means connected to said base support means for resiliently clamping said pivotable shank to said base supporting means;

said resilient connector means includes a pair of upwardly projecting resilient fingers, each finger engageable on one side of said shank, said fingers resiliently engageable to said shank for holding said shank in a predetermined position;

said fingers include an upper flanged portion protruding laterally inward toward each other, said lateral flanged portions separated by a distance less than the width of said shank, said shank moveable to a position between said fingers, whereby the flange portions will prevent upward, vertical motion of said shank; and resilient shank engaging means moveable laterally outwardly from said shank when engaged with said shank, said resilient means having a fluke engaging means whereby said flukes are engaged to said resilient means whenever said shank is positioned between said resilient means.

2. A device, as in claim 1, wherein:

said anchor body engaging means is connected to said crown plate.

3. An anchor chock for securing a twin fluke anchor having a crown, a stock, a pivotable shank, a pair of flukes disposed on each side of said crown, said flukes lying in the same plane, said chock comprising:

a base plate;

a crown plate receptacle disposed at one end of said base plate for preventing lateral and vertical motion of said crown;

a first pair of resilient fingers substantially perpendicularly connected to said plate and rising upwardly therefrom, said fingers having flanged inwardly projecting portions juxtaposed to each other, the distance between said projection portions being smaller than a width of an anchor shank, whereby said shank is moveable between said fingers and may be resiliently retained between said fingers; and a second pair of resilient fingers positioned adjacent said first pair of fingers and connected to said plate, said second fingers having inwardly disposed projections disposed adjacent each other and fluke engaging projections disposed outwardly, said inner projections spaced apart a distance less than the width of said shank whereby whenever said shank is engaged between said second fingers, said fluke engaging means engages said flukes.

* * * * *